US007481026B2

(12) United States Patent
Silverman

(10) Patent No.: US 7,481,026 B2
(45) Date of Patent: Jan. 27, 2009

(54) TILT WINDOW ASSEMBLY

(75) Inventor: Arthur Silverman, Warren, NJ (US)

(73) Assignee: BB Plastics, L.L.C., North Brunswick, NJ (US)

( * ) Notice: Subject to any disclaimer, the term of this patent is extended or adjusted under 35 U.S.C. 154(b) by 0 days.

(21) Appl. No.: 10/672,331

(22) Filed: Sep. 26, 2003

(65) Prior Publication Data

US 2005/0066582 A1 Mar. 31, 2005

(51) Int. Cl.
*E05D 15/58* (2006.01)

(52) U.S. Cl. ..... 49/258; 49/188; 49/189; 49/257; 49/260; 49/453; 49/455; 16/229; 16/239

(58) Field of Classification Search ..... 49/188, 49/189, 212, 213, 208, 257, 258, 259, 260, 49/453, 455; 16/229, 239, 386
See application file for complete search history.

(56) References Cited

U.S. PATENT DOCUMENTS

| | | | | |
|---|---|---|---|---|
| 529,171 | A | 11/1894 | Hegenscheidt | |
| 2,308,978 | A | 1/1943 | Jolivette | |
| 2,608,727 | A * | 9/1952 | Ball | 49/257 |
| 2,928,116 | A | 3/1960 | Bengtsson | |
| 3,959,926 | A | 6/1976 | Noecker et al. | |
| 4,222,201 | A * | 9/1980 | Yanessa | 49/189 |
| 4,802,307 | A | 2/1989 | Schmidt | |
| 6,018,911 | A * | 2/2000 | Menegazzo | 49/213 |
| 6,119,307 | A * | 9/2000 | Weishar et al. | 16/87 R |
| 6,470,627 | B2 | 10/2002 | Fukuo | |
| 6,497,072 | B2 | 12/2002 | Fries | |
| 2004/0148864 | A1 * | 8/2004 | Pax et al. | 049/209 |

FOREIGN PATENT DOCUMENTS

| | | | |
|---|---|---|---|
| GB | 2064642 | A * | 6/1981 |
| JP | 58-210289 | A | 7/1983 |

* cited by examiner

*Primary Examiner*—Jerry Redman
(74) *Attorney, Agent, or Firm*—Lerner, David, Littenberg, Krumholz & Mentlik, LLP

(57) ABSTRACT

A new and improved window assembly includes a window frame, and a window sash having an open-tilted and a closed position. The window sash has pivot pins that engage kidney shaped receptacles located on the window frame. The kidney shaped receptacles permit movement of the window sash into the open-tilted or closed position. The design of the present invention minimizes the parts needed to assemble the window assembly making such a window assembly cheaper to manufacture and easier to assemble.

31 Claims, 11 Drawing Sheets

TILT WINDOW ASSEMBLY

BACKGROUND OF THE INVENTION

The present invention relates generally to a window assembly, and more particularly to a cost-effective hopper window assembly that is capable of maintaining an open-tilted position.

When a simple window assembly is preferred, it is well known in the art to utilize a hopper window, i.e., a horizontal window comprising a window frame and a single window sash. Such window hoppers may be intended for use at or below grade for the purpose of ventilating a basement or cellar. Alternatively, window hoppers may be located in a basement cellar so that during construction of a building, the cellar window hopper allows construction workers to pass tools into and out of the building. In such situations, hopper windows are an alternative to the traditional double-hung window assemblies.

Hopper window assemblies are typically designed to open from the top of the window so as to allow the window to tilt inwards into a building. This allows for greater ease in cleaning the exterior side of the window assemblies. Hopper window assemblies are generally capable of maintaining a plurality of positions. However, to achieve such positions, prior art window assemblies often require the assembly and installation of additional window devices in order to position and maintain the window hopper in various positions.

For example, it is known in the art to use a shoe and bracket assembly in order to position the window sash of a window hopper assembly at various angular positions. The shoe is generally comprised of several components, including a spring that provides a biasing force against the bracket. An arm is then used to connect the window sash to the shoe so as to permit the window sash to be tilted and maintained at any angle between the window sash's open and closed position.

These and similar hopper window assemblies that require the installation of additional parts or devices have several drawbacks in terms of cost and time. The increase in parts requires the manufacture of more intricate window sashes, corresponding window frames, and devices capable of manipulating the angular position of the window sashes. The increase in the number of parts naturally lends itself to the need for additional assembly time. The addition of a shoe and bracket assembly to a window hopper assembly will require the assembly of the shoe in the bracket, as well as, the connection of the arm at one end to the shoe bracket and the connection of the arm at its other end to the window sash. Furthermore, there may be additional costs associated with maintaining such hopper window assemblies because replacement parts may be required after devices used in the window assembly have worn down over time. Indeed, the more parts that are needed for the window assembly, the greater the probability that one or more parts will break down.

Additionally, the window sashes of prior art window hopper assemblies are difficult to remove due to the window connections between the window sashes and the window frames. Removal of such window sashes requires the need for additional tools and time to remove the window connections. Moreover, if the decision is made not to remove the window connections, such that the window sash is not separated from the window frame, construction workers and the like must very carefully hand tools or items through the window opening without destroying the window connections or the glass window pane.

It would therefore be beneficial to provide a window assembly that is sturdy, cheaper to manufacture, and easy to assemble, as well as, one that requires little to no maintenance, and provides greater ease for construction workers and the like to pass materials into and out of a building.

SUMMARY OF THE INVENTION

The present invention overcomes the shortcomings of the prior art by providing a window assembly that is cheaper to manufacture, easy to assemble, less likely to breakdown, and requires little to no maintenance. The present invention requires few parts; namely, a window frame, a window sash and window pane, and pivot pins. In other words, the window assembly according to the present invention does not require the installation of additional parts or devices to maintain the window sash in stationary positions, such as those disclosed in the prior art. Moreover, the ability of the window sash of the present invention to be completely removed from the window frame provides construction workers and the like greater ease in passing tools into and out of the building. Accordingly, various window assemblies in accordance with the present invention are disclosed which reduce the number of parts needed to assemble a hopper window assembly, as well as, reduce the costs associated with the manufacture, installation and maintenance of same.

According to one aspect of the present invention, there is a window frame having a lower portion. A window sash is constructed to be positioned within said window frame and capable of moving from a closed position to an open-tilted position, and vice versa. There is also a pair of parallel pivot pins on the window sash. A pair of kidney shaped receptacles is further disposed within said window frame which accommodate movement of the window sash from its said closed position to its open-tilted position and vice versa.

In accordance with a preferred embodiment of this aspect of the invention, in its open-tilted position, the window sash cooperates with the window frame so that the window sash abuts the window frame at its lower portion. The lower portion of the window frame limits the extent of the open-tilted position by preventing further movement of the window sash.

In accordance with a further embodiment of this aspect of the present invention, at least one parallel pivot pin of the pair of parallel pivot pins is retractable.

In accordance with a still further embodiment of this aspect of the present invention, an insertion channel is connected to at least one of the kidney shaped receptacles. The insertion channel permits the window sash to be inserted into the window frame in a tilted position when one of the parallel pivot pins engages the insertion channel, thereby allowing the window frame to move down into the kidney shaped receptacles and into a fully inserted position.

In accordance with yet another embodiment of this aspect of the present invention, the lower portion of the window frame that supports the window sash in its open-tilted position comprises a water dam. When the window sash abuts the water dam, the water dam prevents further movement of the window sash so as to define the maximum open-tilted position of the window sash.

In accordance with a still further embodiment of the present invention, the water dam further comprises an angular portion for supporting the window sash.

In accordance with a further embodiment of this aspect of the present invention, a sash stop is located on the window sash. The sash stop is similar to the sash stop commonly used to lift a window sash of a double hung window assembly. When the window sash is in an open-tilted position, the sash stop engages the surface of the window frame so as to limit the maximum open-tilted position of said window sash.

In accordance with another embodiment of this aspect of the present invention, the window sash further comprises a sash mating surface, and the window frame further comprises a frame mating surface. The said sash mating surface is arranged and constructed so as to be complementary to the frame mating surface.

In accordance with a still further embodiment of this aspect of the present invention, the surface of the window frame is a cam-like curved surface.

In accordance with another aspect of the present invention, a window assembly comprises a window frame, a window sash that has a connection means which is able to connect the window sash to the window frame so as to allow the window sash to attain a plurality of positions within the window frame, including an open-tilted and a closed position, a supporting means for supporting the window sash in an open-tilted position, and a pair of kidney shaped channels to receive the connection means.

In accordance with an embodiment of this aspect of the present invention, the supporting means is a water dam.

In accordance with an embodiment of this aspect of the present invention, the supporting means includes includes a sash stop.

In accordance with an embodiment of this aspect of the present invention, the connection means includes a pair of pivot pins.

In accordance with a further embodiment of this aspect of the present invention, the pair of pivot pins are retractable.

In accordance with another embodiment of this aspect of the present invention, the window sash further comprises a sash mating surface, and the window frame further comprises a frame mating surface. The said sash mating surface is arranged and constructed so as to be complementary to the frame mating surface.

In accordance with another aspect of the present invention, a window assembly comprises a window frame and a window sash constructed to be positioned within the window frame and capable of moving from a closed position to an open-tilted position. The window sash further has a pair of parallel pivot pins to accommodate movement of the window sash from its closed position to its open-tilted position and vice versa. There is also a dual function water dam located on the window frame, and a pair of channels located on the window frame. The dual function water dam serves two purposes. First, it limits the water permitted to enter a building through the window assembly caused during a rainstorm. Second, it provides support to the window sash when the window sash is in an open-tilted position. There are also two channels located on the window frame that are arranged and constructed to respectively receive each of the pivot pins.

In accordance with an embodiment of this aspect of the present invention, the channels are kidney shaped receptacles.

In accordance with another embodiment of this aspect of the present invention, the window sash further comprises a sash mating surface, and the window frame further comprises a frame mating surface. The said sash mating surface is arranged and constructed so as to be complementary to the frame mating surface.

In accordance with another aspect of the present invention, a window assembly comprises a window frame, a window sash having a plurality of angular positions within the window frame, including an open-tilted and a closed position, a first and second channel, a support means for supporting the window sash, and a connection means for connecting the window sash and the window frame. The window frame has a first horizontal arm, a second horizontal arm, a first vertical arm, and a second vertical arm. Similarly, the window sash comprises a first horizontal sash rail, a second horizontal sash rail, a first vertical sash rail, and a second vertical sash rail. The window sash is arranged and constructed for insertion into the opening of the window frame. The first channel is located on the first vertical arm of the window frame and a second kidney shaped channel is located on the second vertical arm. The channels are both capable of receiving a connecting means for connecting the window sash to the fixed frame.

In accordance with an embodiment of this aspect of the present invention, the connecting means is a pair of pivot pins.

In accordance with an embodiment of this aspect of the present invention, the support means for is a water dam.

In accordance with yet another embodiment of this aspect of the present invention, the support means for is a sash stop.

In accordance with another embodiment of this aspect of the present invention, the window sash further comprises a sash mating surface, and the window frame further comprises a frame mating surface. The said sash mating surface is arranged and constructed so as to be complementary to the frame mating surface.

In accordance with another aspect of the present invention, a window assembly comprises a fixed window frame, a kidney shape channel, a window sash arranged and constructed so as to be inserted into the window frame, and further having an open-tilted position and a closed position, and a support means for supporting the window sash when the window sash is in an open-tilted position. The window frame has a first horizontal arm, a second horizontal arm, a first vertical arm, and a second vertical arm. The window sash comprises a first horizontal sash rail, a second horizontal sash rail, a first vertical sash rail, and a second vertical sash rail. The window sash also has a pin located in one of the vertical sash rails. The pin is received by the kidney shaped channel that is located in at least one vertical arm of the fixed window frame.

In accordance with another embodiment of several aspects of the present invention, the only connection between the window sash and the window frame is the pair of parallel pivot pins, such that the window sash can be easily removed from the window frame.

These and other features and characteristics of the present invention will be apparent from the following detailed description of preferred embodiments which should be read in light of the accompanying drawings in which corresponding reference numbers refer to corresponding parts throughout the several views.

DETAILED DESCRIPTION

Figure 1:
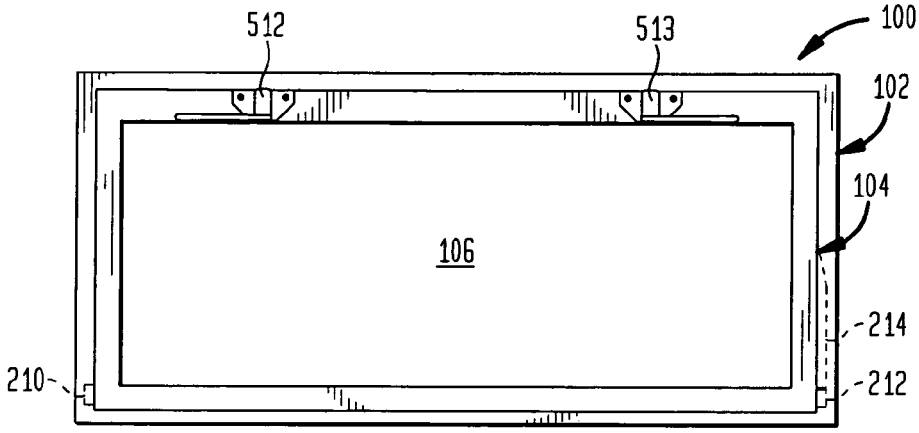
FIG. 1 is a front view of a preferred window assembly according to the present invention.
Figure 1A:
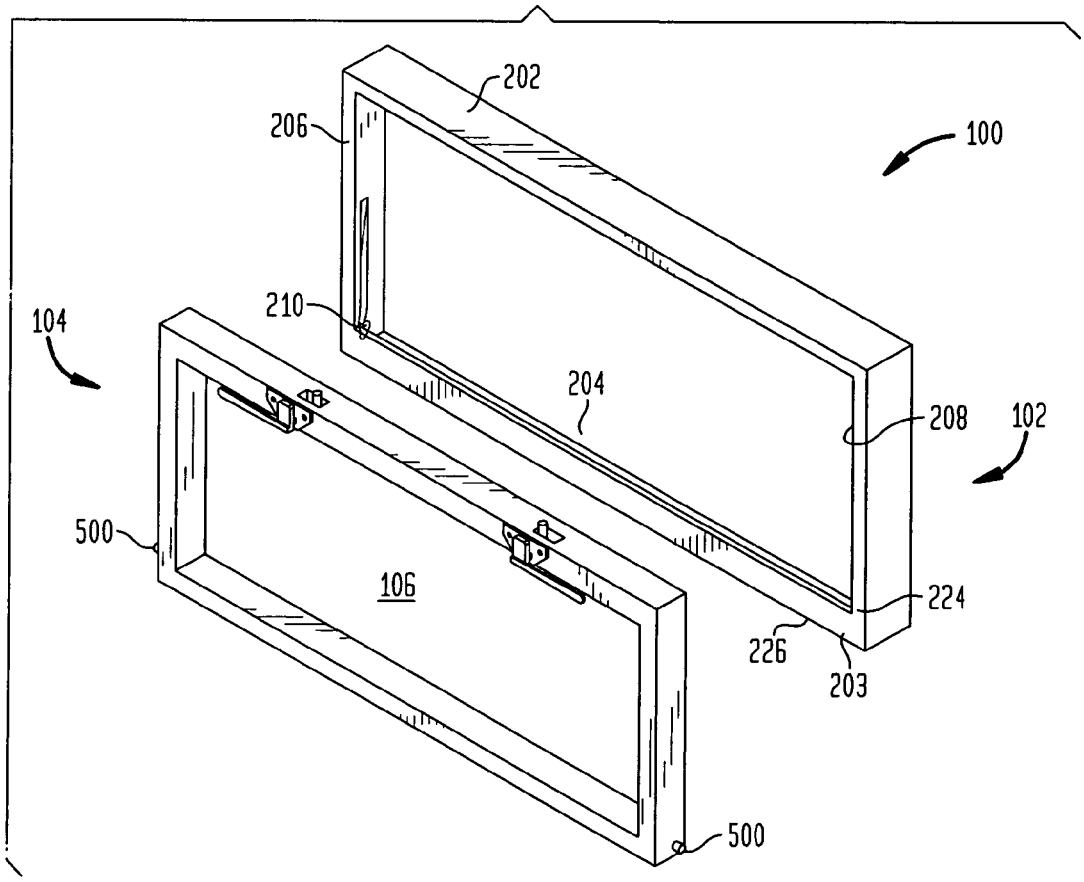
FIG. 1A is a rear perspective view of the preferred window assembly shown in FIG. 1 according to the present invention.

The present invention is generally directed to a window assembly 100, such as the window assembly 100 shown in FIGS. 1 and 1A. The window assembly 100 is preferably comprised of a window frame 102, and a window sash assembly 104 that has pivot pins 500 and a glass window unit or windowpane 106. The window assembly 100 is constructed and arranged so that the window sash assembly 104 and window frame 102 cooperate with one another to permit the rotation of the window sash assembly 104 relative to the window frame 102. Specifically, as shown in FIG. 1A, pivot pins 500 are able to move within kidney shaped receptacles 210 located on the window frame 102 that guide the tilting movement of the window sash assembly 104 relative to the window frame 102. The window sash is therefore able to achieve a plurality of positions, including an open-tilted and closed position. While the present invention will be described primarily with respect to a single-hung window assembly, it should, however, be appreciated that the present invention can be used in connection with various other types of pivotal windows or structures including, but not limited to, a double-hung window assembly, a vertical pivot window assembly, and the like, wherein it is desired to install a window that is efficient in terms of time and cost.

Figure 2:
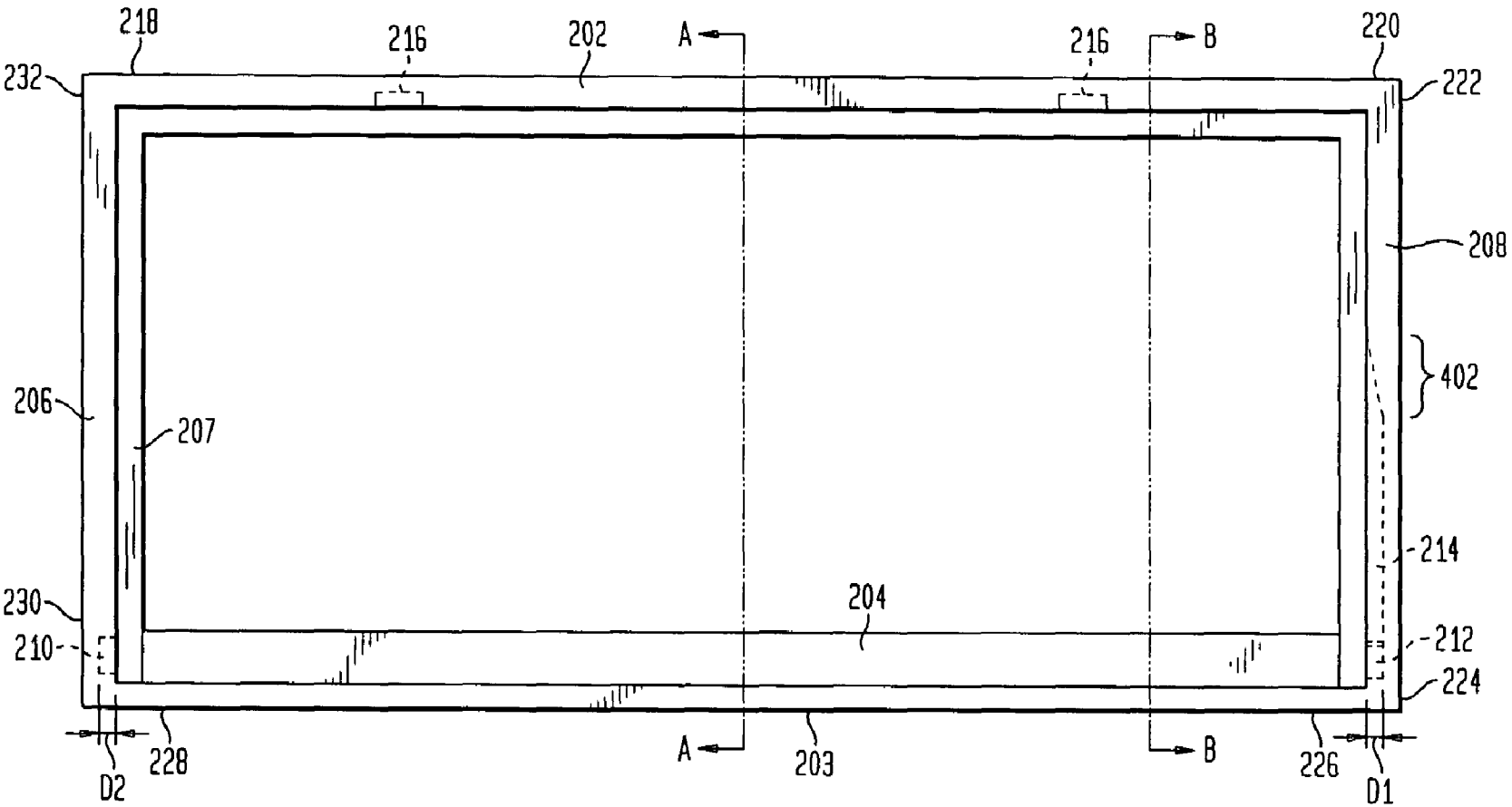
FIG. 2 is a front view of a preferred window frame according to the present invention.

The window frame 102 comprises a plurality of members joined together at their respective ends. As shown in FIG. 2, the header 202 is joined at a first end 218 with a second end 232 of the left window jamb 206. At its second end 220, the header 202 is joined with the first end 222 of the right window jamb 208. The second end 224 of the right window jamb 208 is joined with the first end 226 of footer 203 (see FIG. 1A). At its second end 228, the footer 203 is joined with the first end 230 of the left window jamb 206.

As seen in FIGS. 1A and 2, the water dam 204 is located in front of footer 203 so as to prevent water, wind, or other elements of the outdoors from invading the interior of a building. As will be discussed in greater detail herein, the water dam 204 may also serve as a means for supporting the window sash in its open-tilted position. It should be appreciated, however, that the water dam 204 may be integrally formed with the footer 203 in order to save on the cost of materials during manufacture of the window frame 102.

Referring to FIG. 2, a sash support 207 is located inwardly of the water dam 204 (see also FIG. 1A) and extends the length around the left window jamb 206, header 202, and right window jamb 208 of the window frame 102. The sash support 207 supports the window sash 104 (see FIG. 1A) when the window sash 104 is in its closed position. It should be appreciated that the sash support 207 need not extend the length of left window jamb 206, header 202, and right window jamb 208 of the window frame 102, nor does it need to be located on all three parts of the window frame 102.

Figure 3:
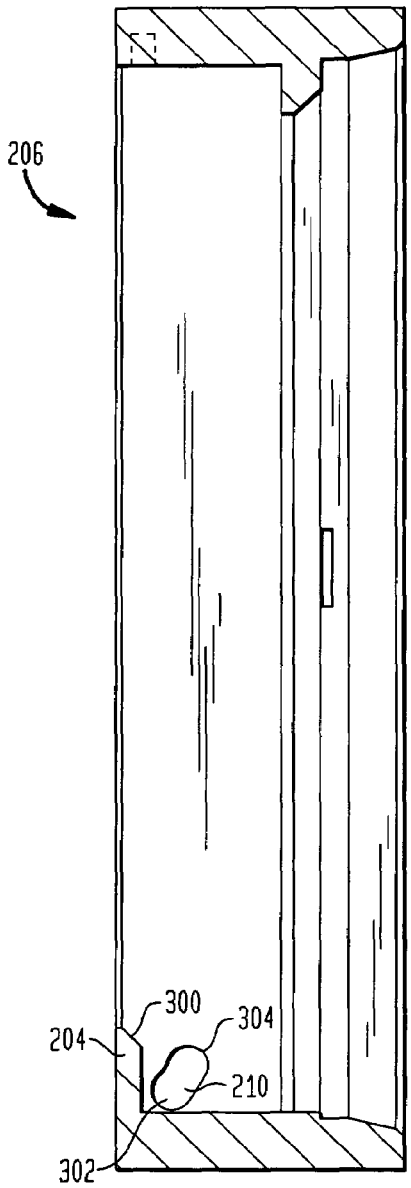
FIG. 3 is a cross sectional view of the left window jamb of the window frame in FIG. 2.
Figure 3A:
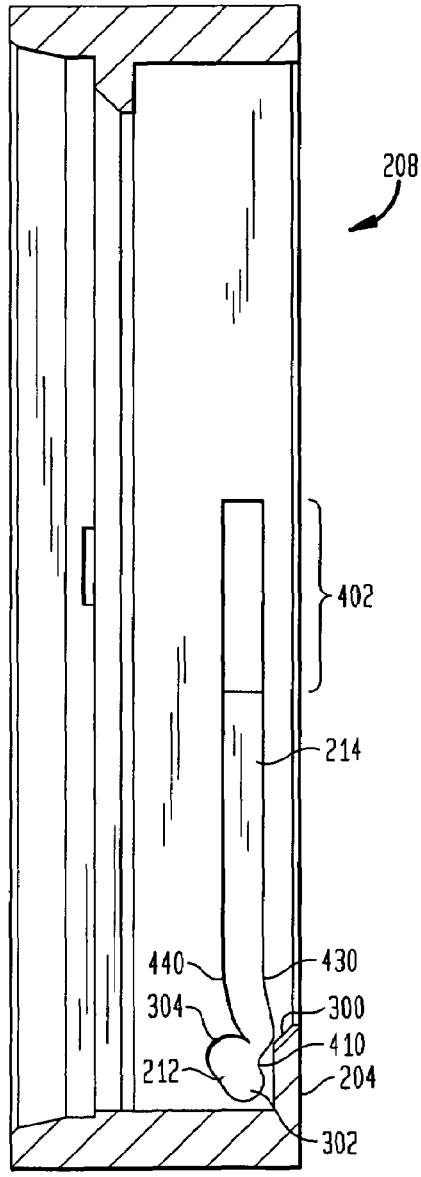
FIG. 3A is a cross sectional view of the right window jamb of the window frame in FIG. 2.

An important feature of the present invention is best shown in FIGS. 3-3A, which are cross-sectional views of the left window jamb 206 and right window jamb 208, respectively. Specifically, a pair of kidney shaped receptacles 210, 212 are located on the lower regions of the left window jamb 206 (see FIG. 3) and right window jamb 208 (see FIG. 3A), respectively, as well as, close to the water dam 204. The kidney shaped receptacles have an upper kidney end 304 and a lower kidney end 302. As shown in FIG. 3A, there is an insertion channel 214 located on the right window jamb 208 that is connected to the upper kidney end 304 of the kidney shaped receptacle 212. Additionally, there is a transition region 402, located at the beginning of the insertion channel 214. It should be appreciated that the insertion channel 214 may instead be located on the left window jamb, or alternatively on both left and right window jambs 206, 208. As can be seen in FIG. 2, the kidney-shaped receptacles 210,212 are disposed in a line substantially in parallel with the footer 203 to provide for tilting movement of the window sash 104 by means of the pivot pins 500.

Referring back to FIG. 2, the depth D1 of the kidney shaped receptacles 210,212 ranges from 0.325-0.425 inches. The depth D2 of the insertion channel 214 is dependent upon the depth of the kidney shaped receptacle 212 to which the insertion channel 214 is connected. Accordingly, the depth of the insertion channel 214 will also range from 0.325-0.425 inches. The depth of the transition region 402 of the insertion channel 214 is gradually shallower in depth than the remainder of the insertion channel 214. However, at the point where the transition region 402 and insertion channel 214 meet, the depth of the transition region 402 will equal the depth of the insertion channel 214.

Figure 4:
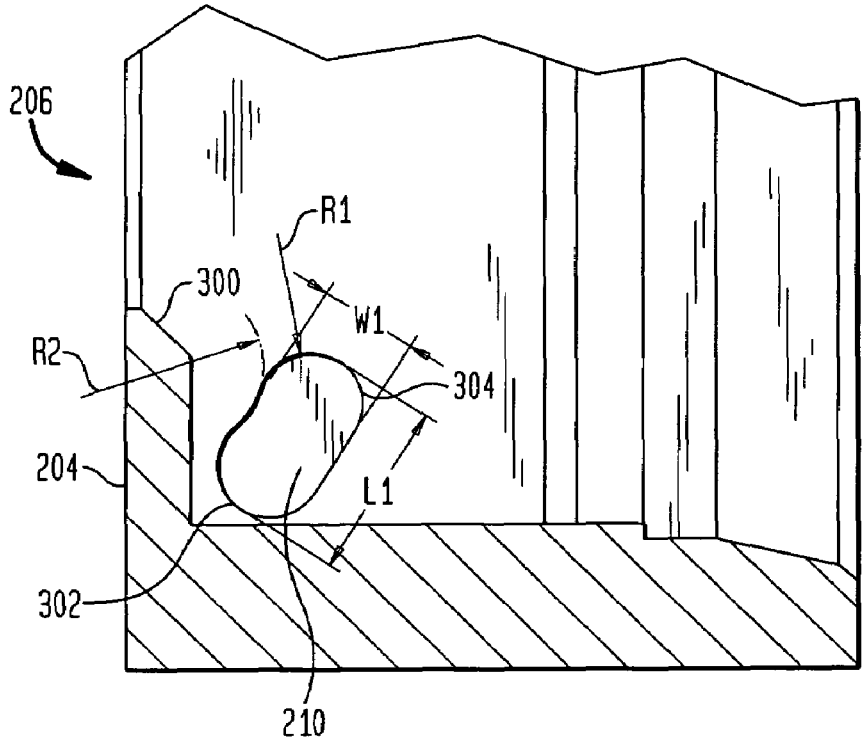
FIG. 4 is a cross sectional cut-away view of the lower portion of the left window jamb of the window frame in FIG. 2.
Figure 4A:
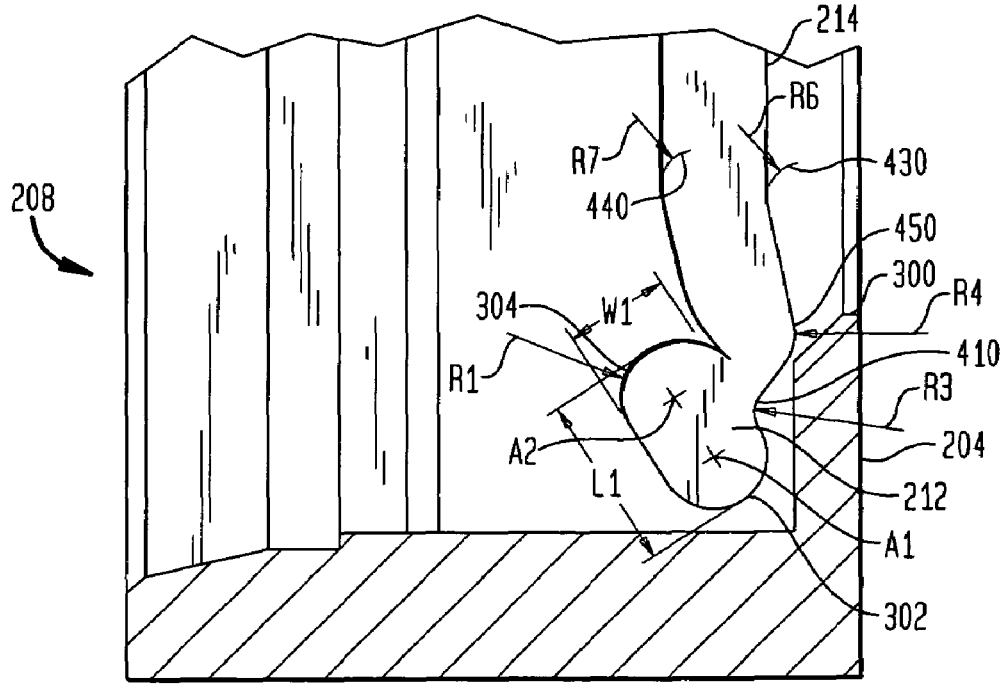
FIG. 4A is a cross sectional cut-away view of the lower portion of the right window jamb of the window frame in FIG. 2.

FIGS. 4 and 4A show cross-sectional cut away portions of the lower portions of the left and right window jambs 206,208 that illustrate the kidney shaped receptacles 210,212 and insertion channel 214 in greater detail. In a preferred embodiment, the radii R1 of the upper and lower kidney ends 302,304 of the kidney shaped receptacles 210,212 preferably range from approximately 0.20-0.30 inches. The length L1 of the kidney shaped receptacles ranges from approximately 0.725-0.825 inches, and the width W1 of the kidney shaped receptacles 210, 212 ranges from 0.45-0.55 inches. As shown in FIG. 3A, the insertion channel 214 that connects to the kidney shaped receptacle 212 on the right window jamb 208 has a length ranging from 5 to 10 inches, and a width ranging from 0.45-0.55 inches.

As shown in FIG. 4A, the insertion channel 214 has several curves at or near the point where it intersects the kidney shaped receptacle 212. It is believed that such a configuration enables greater ease during installation and mounting of the window sash assembly 104 (see FIG. 1A) within the window frame 102, as it helps to facilitate movement of the pivot pin 500 through the insertion channel 214 and into the kidney shaped receptacle 212.

A lower inner curve 410 is formed at the point where the insertion channel 214 is connected to the kidney shaped receptacle 212. The lower inner curve 410 has a radius of curvature R3 ranging from 0.075-0.175 inches. An intermediate curve 450 is located above the lower inner curve 410 and adjacent to the open-tilt support 300. Intermediate curve 450 has a radius of curvature R4 ranging from approximately 0.20-0.30 inches. A right insertion channel curve 430 is located above the intermediate curve 450 and has a radius of curvature R6 ranging from approximately 0.075-0.175 inches. A left insertion channel curve 440 is located above the upper inner curve 420 and has a radius R5 ranging from approximately 0.20-0.30 inches. It should be appreciated, however, that the aforementioned dimensions of the kidney shaped receptacles 210, 212 and insertion channel 214 may vary based on the size of the window frame. Additionally, in insertion channel may have more or fewer curves without departing from the scope of the present invention.

Figure 5:
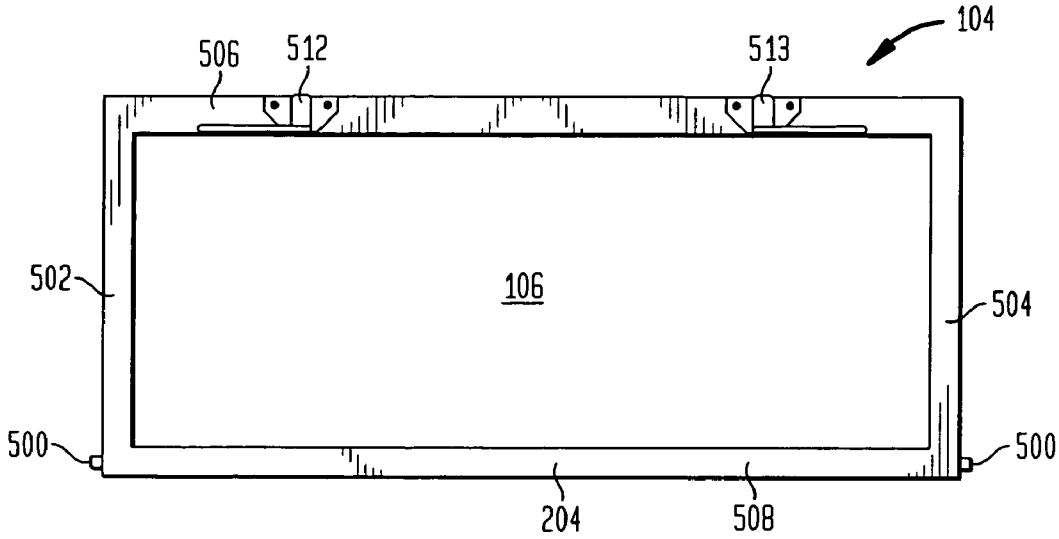
FIG. 5 is a front view of the preferred window sash shown in FIG. 1.

A preferred window sash assembly 104 according to the present invention is shown in FIG. 5. The window sash assembly 104 is formed by the union of the left sash rail 502, right sash rail 504, upper sash rail 506, and lower sash rail 508 (see FIG. 1A) at their outermost ends. The pivot pins 500 are located on the outer portion of opposed lower ends of the window sash assembly 104. The window pane 106 is embedded in the window sash assembly 104. The window pane 106 may be comprised of any number of materials, such as plastic, glass, or a screen material.

Figure 6:
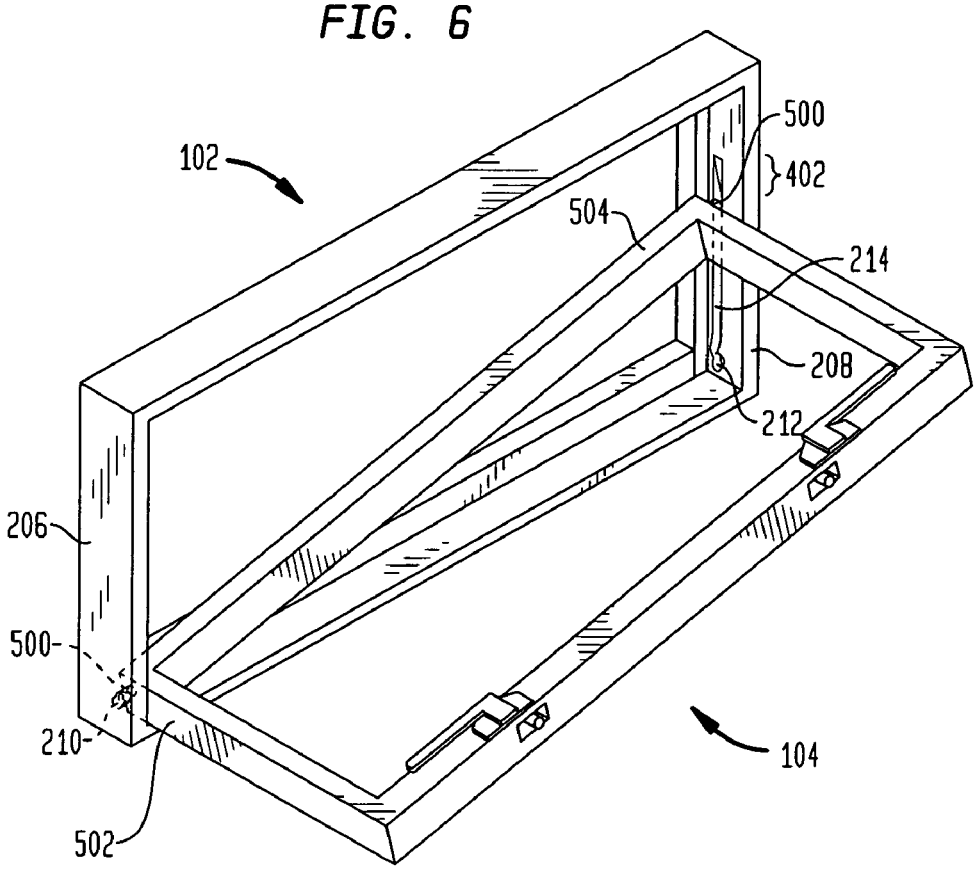
FIG. 6 is a perspective view of the installation of a window sash into a window frame, as shown in FIG. 1, according to the present invention.

Based on these features of the window sash assembly 104 and window frame 102, mounting of the window sash assembly 104 into the window frame 102 is easily accomplished as compared with prior art windows which require the installation and assembly of additional window assembly parts. Referring to FIG. 6, the window sash assembly 104 is mounted on the window frame 102 by first horizontally tilting the window sash assembly 104 so that the right sash rail 504 is higher than the left sash rail 502. The pivot pin 500 located on the right sash rail 504 is then placed into the transition region 402 of the insertion channel 214, while the pivot pin 500 located on the left sash rail 502 is placed into and engages the kidney shaped channel 210 located on the left window jamb 206. Once the pivot pin 500 located on the left window jamb 206 is secured within the kidney shaped receptacle 210, the pivot pin 500 located on the right window jamb 208 is able to slide into the insertion channel 214, beginning at the transition region 402. Due to the transition region 402, the pivot pin 500 of the window sash assembly 104 is able to easily move through the insertion channel 214, and down into the kidney shaped receptacle 212 on the right window jamb 208.

In an alternative embodiment of a window assembly 100 of the present invention, retractable pins, which could be the pins 500, can be used on either or both the left and right sash rails 502, 504. The retractable pins can be retracted into the window sash assembly 104, such that during window assembly, it is unnecessary to horizontally tilt the window sash assembly 104 so as to allow a pin to engage the insertion channel 214. Instead, retraction of the pins allows the window sash assembly 104 to fit directly into the opening of the window frame 102, such that the pivot pins 500 are able to easily engage the kidney shaped receptacles 210,212. This configuration eliminates the need for the construction and arrangement of the insertion channel 214 in the right window jamb 208. Accordingly, in such a configuration, only the kidney shaped receptacles 210,212 need be located on the lower regions of the left and right window jambs 206, 208.

Referring to FIGS. 7-10, when mounted in the window frame 102, the window sash assembly 104 is capable of achieving a plurality of angular positions. However, the kidney shaped receptacles 210, 212 advantageously permit the window sash assembly to achieve two stationary or stable positions. A lower stable position provides a fully closed window, and a higher stable position provides a sufficient tilt-opening when a water dam is employed. Accordingly, the window sash assembly 104 has a stable closed position, and a stable open-tilted position. It should be further appreciated that the window can also maintain various stable angular positions due to further construction and arrangement of the window assembly, without departing from the spirit and scope of the present invention.

Figure 7:
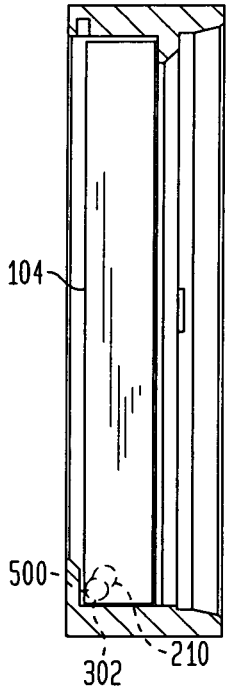
FIG. 7 is a cross-sectional view of the left window jamb of the window frame shown in FIG. 1 and a preferred window sash shown in FIG. 1 in a closed position.
Figure 8:
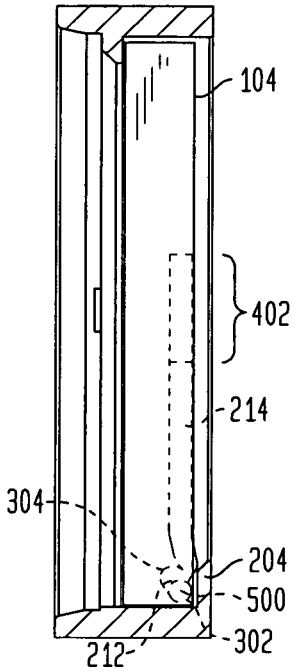
FIG. 8 is a cross sectional view of the right window jamb of the window frame shown in FIG. 1 and the preferred window sash in a closed position.

The window sash assembly 104 is in a non-pivoted or closed position when it rests within the left and right window jambs 206,208 of the window frame 102. As shown in FIGS. 7 and 8, this occurs when the pivot pin 500 of the left and right sash rails 502,504 (see FIG. 6) engage the lower end 302 of the kidney shaped receptacles 210, 212 of the left and right window jambs 206,208 respectively. The window sash assembly 104 can then be locked in the window frame 102 when the left lock control 512 (see FIG. 5) and right lock control 513 manipulate a locking mechanism, such as a lock pin (not shown), to engage the lock openings 216 (see FIG. 2) of the window frame 102. Use of the two handles is advantageous to better secure the window frame, as well as, to help better insulate a building against the outdoor elements, such as wind and water. Alternatively, one lock control may be utilized to secure the window sash. In such an alternative embodiment, the lock control is preferably located in the center of the upper rail of the window sash assembly 104.

Figure 9:
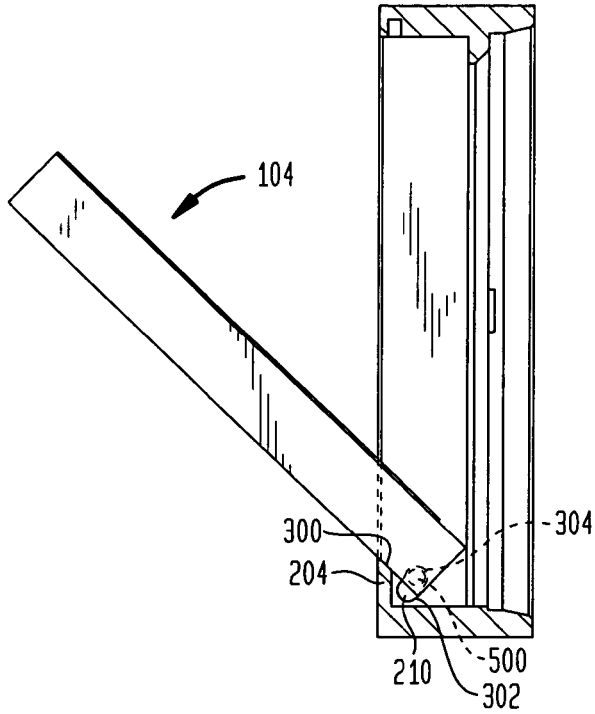
FIG. 9 is a cross sectional view of the right window jamb of the window frame shown in FIG. 1 and the preferred window sash in an open position.
Figure 10:
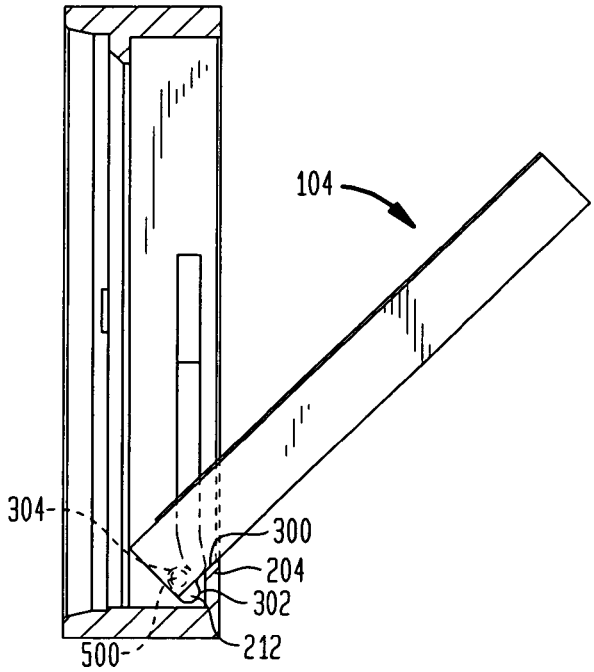
FIG. 10 is a cross sectional view of the left window jamb of the window frame shown in FIG. 1 and the preferred window sash in an open position.

Referring to FIGS. 9 and 10, the window sash assembly 104 is in an open-tilted stationary position when the window sash assembly 104 is at its maximum open position. This occurs when the pivot pins 500 of the left and right sash rails 502,504 engage the upper kidney end 304 of the kidney shaped receptacles 212 of the right and left window jambs 206,208. Additionally, in another important feature of the present invention, a support means is provided for holding the window sash assembly 104 in its open-tilted position. In a preferred embodiment, a water dam 204 is used to support the window sash assembly 104 in its open-tilted position. As such, the water dam 204 serves a dual purpose. First, it is a water barrier that minimizes the amount of water that may enter the interior of a building during a rainstorm. Second, it is a support for the window sash assembly 104 when the window sash assembly 104 is in its open tilted position.

The window sash assembly 104 will rest on the open-tilt support 300, of the water dam 204, so as to maintain an open-tilted position. The open-tilt support 300 preferably provides a flat surface at an angle that mates with the window sash. In a preferred embodiment, the height of the water dam 204 ranges from 1-2 inches. It should be appreciated that the height of the water dam 204 and/or angle of the open tilt-support 300 can be varied in order to alter the maximum open-tilted position of the window sash assembly 104. This may be especially advantageous if the window assembly 100 is to be located above a tall object and it is desired to position the window such that it will not contact the object when in its open-tilted position.

Figure 11:
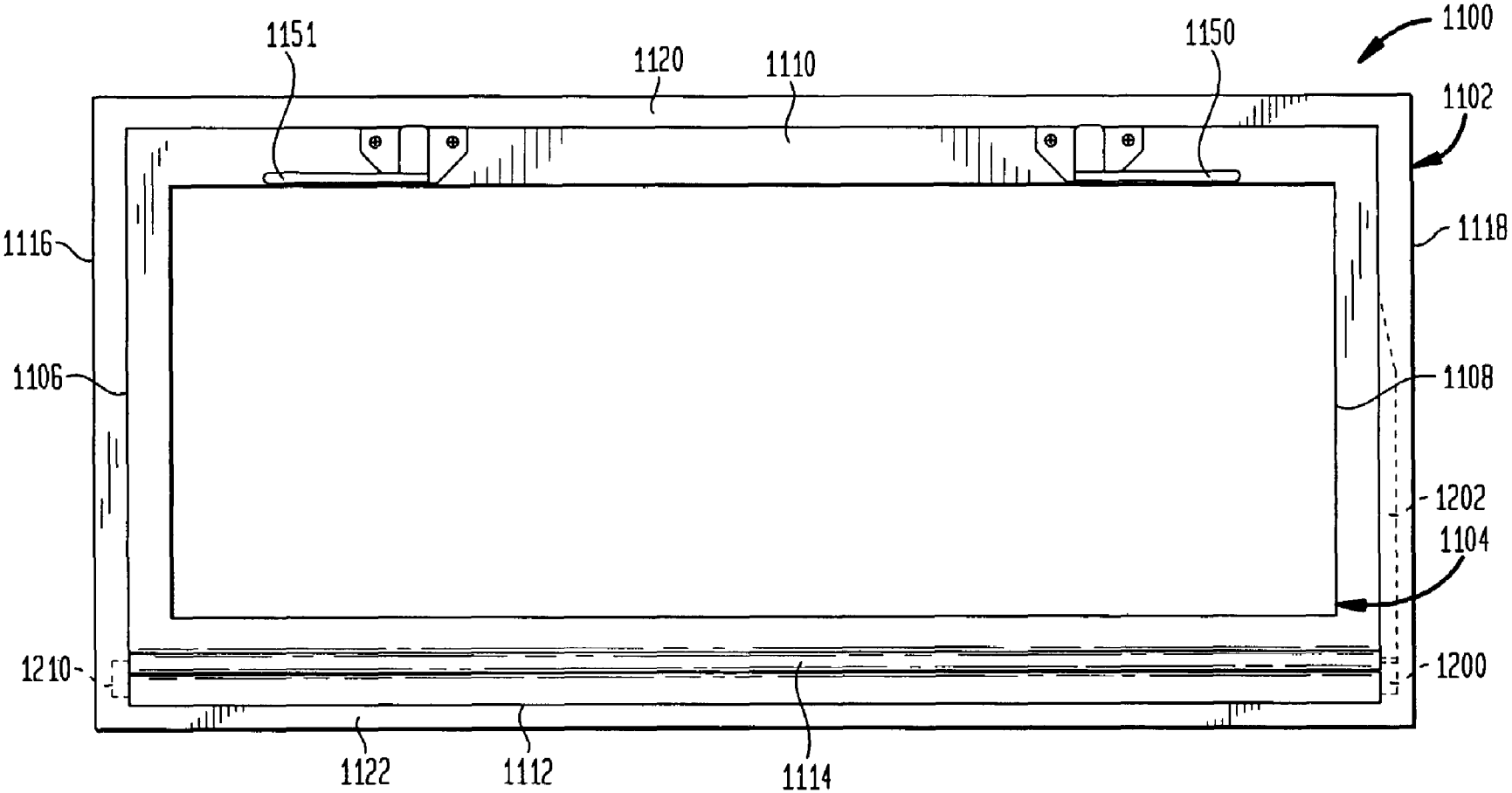
FIG. 11 is a front view of an alternative embodiment of a window assembly according to the present invention.
Figure 13:
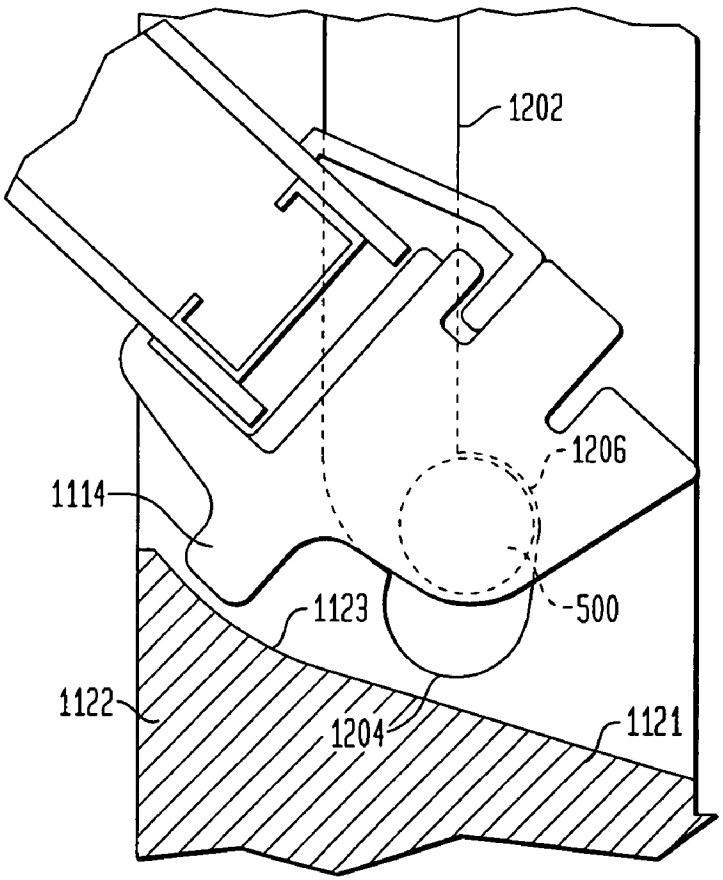
FIG. 13 is a cross-sectional cut-away view of the alternative embodiment shown in FIG. 11 of the right window jamb and the alternative embodiment of a preferred window sash in an open-tilted position.
Figure 12:
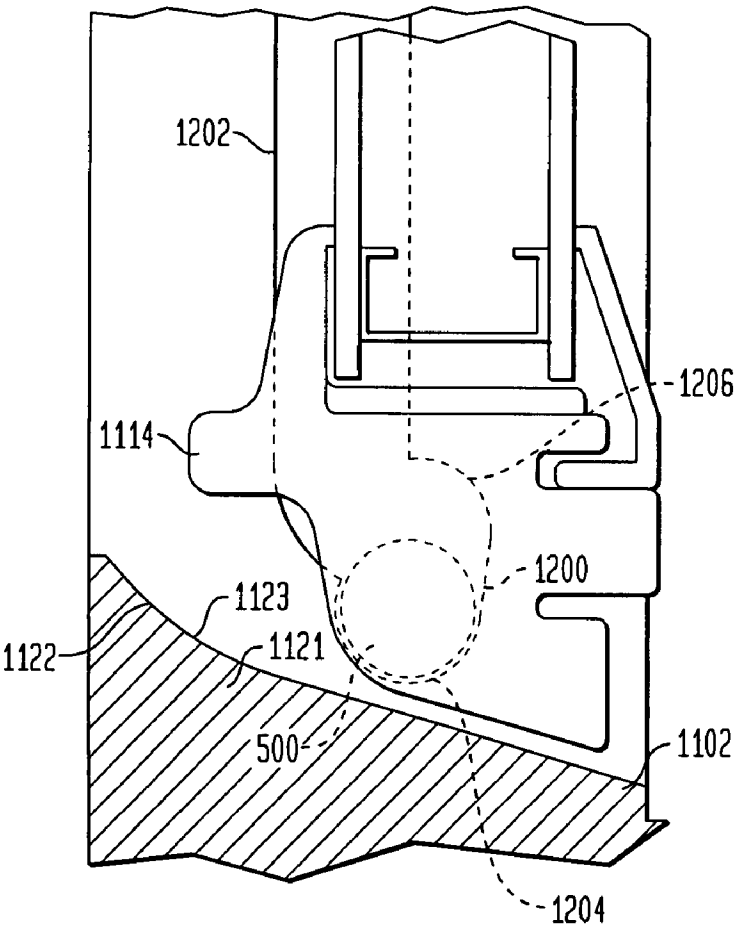
FIG. 12 is a cross-sectional cut-away view of the alternative embodiment shown in FIG. 11 of the second vertical window jamb and an alternative embodiment of a preferred window sash in a closed position. The first vertical window jamb (not shown) of the window sash can be a mirror image of the second vertical window jamb. However, it is not necessary that the first vertical window jamb have an insertion channel connected to the kidney shaped receptacle.
Figure 14:
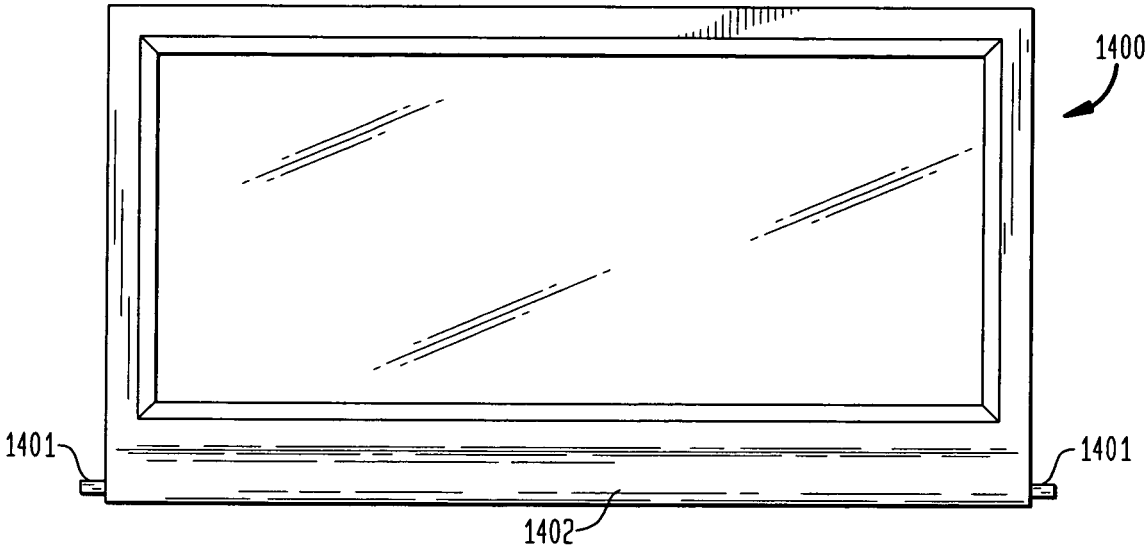
FIG. 14 is a front-view of a window sash assembly according to another embodiment of the present invention.

Referring to FIGS. 11-13, an alternative embodiment for a window assembly 1100 according to the present invention is shown. FIG. 11 shows a front view of an alternative window assembly 1100 according to the present invention comprising a window frame 1102 and a window sash assembly 1104. The window sash assembly 1104 is comprised of a left sash rail 1106, a right sash rail 1108, an upper sash rail 1110, and a lower sash rail 1112, each joined together at their respective ends, pivot pins (not shown), a sill lift 1114 located across the bottom of the window sash assembly 1100, and right handle 1150 and left handle 1151. The sill lift 1114 is constructed and arranged similar to the sill lift handle commonly utilized in a double hung window assembly. Such sill lifts are manually used to lift a window into an open position. The window jambs include cooperating kidney shaped channels, one kidney shaped channel 1210 in a first vertical window jamb 1116, and one kidney shaped channel 1200 (see FIG. 12) in a second vertical window jamb 1118. The window frame 1102 further includes an upper border 1120, and a lower border 1121 (See FIG. 12). A water dam 1122 is located in front of said lower border 1121, and is integrally formed with said lower border 1121. It should be appreciated, however, that the water dam 1122 may be formed separately from the lower border 1121.

Referring to FIG. 12, there is a cross-sectional cut-away view of the window sash assembly 1104 located in its closed position within a first vertical window jamb 1116 and a second vertical window jambs 1118 (see FIG. 11), of the window frame 1102. A kidney shaped receptacle 1200 is shown in the lower region of the second vertical window jamb 1118 (see FIG. 11). An insertion channel 1202 connects to the kidney shaped receptacle 1200 in the second vertical window jamb 1116.

A corresponding kidney shaped receptacle 1210 (see FIG. 11) is located on the first vertical window jamb 1116 without the insertion channel 1202. However, it should be appreciated that the first vertical window jamb 1116 can be constructed and arranged so as to be a mirror image of the second vertical window jamb 1116, thereby having an insertion channel 1202.

Referring to FIG. 13, a cross-sectional cut-away view of the window sash assembly 1104 is shown in its open-tilted position. The pivot pins 500 engage the upper kidney end 1206. The sill lift 1114 rests against the water dam 1122, which preferably has a cam-shaped supporting surface 1123, so as to support the window sash assembly 1104 in its open-tilted position.

Figure 15:
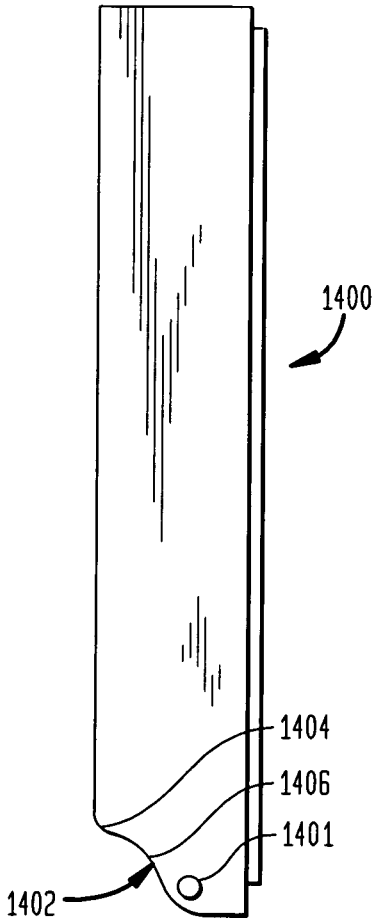
FIG. 15 is a side view of the window sash shown in FIG. 14.
Figure 16:
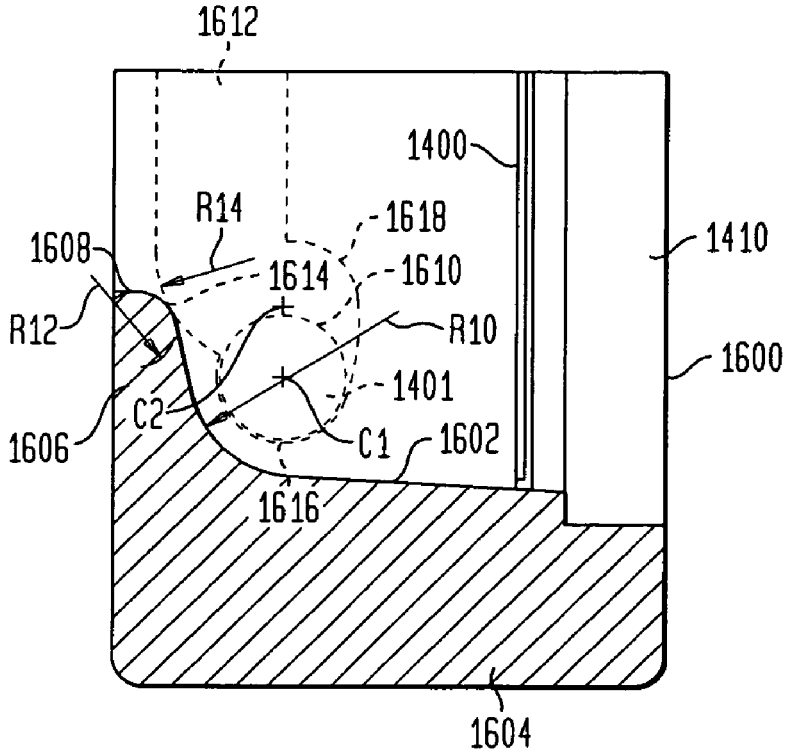
FIG. 16 is a cross-sectional cut-away view of the right window jamb of an alternative window frame assembly and the window sash shown in FIG. 14 in its closed position.

Referring to FIGS. 14-19 there is shown an alternative window assembly according to the present invention comprising a window sash 1400 (See FIGS. 14 and 15) and a window frame 1600 (See FIG. 16). In addition to the typical components of a window sash, such as the top, bottom, right and left sash rails, the window sash further comprises a sash mating surface 1402. As shown in FIG. 15, the sash mating surface 1402 comprises an inner edge 1404 and a sash curve 1406.

The window frame 1600 shown in FIGS. 16-19 comprises a header (not shown), a right window jamb 1410 (See FIG. 16), a left window jamb 1412(See FIG. 17), a footer 1604, and a water dam 1606. The footer 1604 and water dam 1606 are preferably formed from a unitary piece of material such that there is a uniform frame mating surface 1602. The water dam 1606 is greater in height than the footer 1604, such that the frame mating surface 1602 has an angular slope that is complementary to the sash mating surface 1402 (see FIG. 15). The angular slope of the frame mating surface 1602 preferably has a radius of curvature R10 ranging from 0.388-0.488 inches. There is also a frame mating edge 1608 located at the top of the water dam 1606. At the point where the frame mating edge 1608 of the frame mating surface 1602 connects with the remainder of the frame mating surface 1602, there is an upper radius of curvature R12 preferably ranging from 0.15-0.20 inches.

Figure 17:
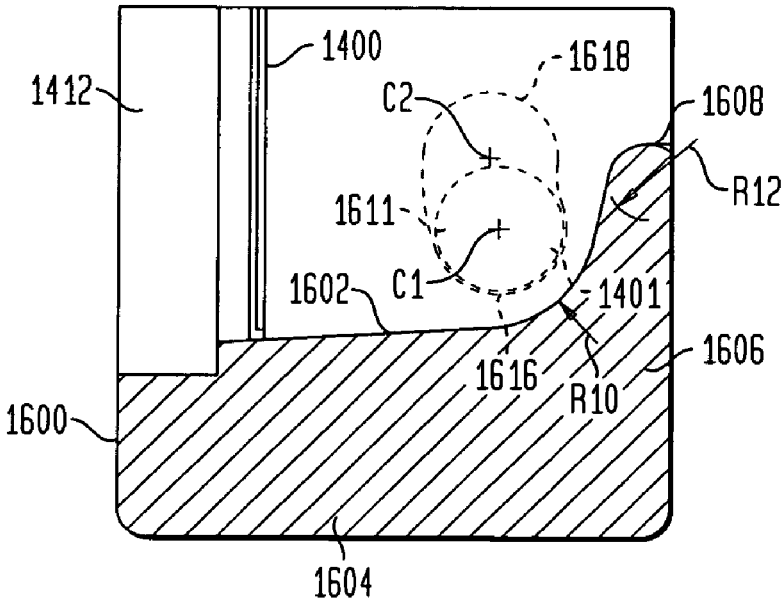
FIG. 17 is a cross-sectional cut-away view of the left window jamb of the window frame assembly shown in FIG. 16 and the window sash shown in FIG. 14 in its closed position.

As shown in FIGS. 16 and 17, the window frame is further characterized by kidney shaped receptacles 1610, 1611 respectively located on the right and left window jambs 1410, 1412 that receive the pivot pins 1401 of the window sash 1400. The center C1 of the lower kidney end 1616 of the kidney shaped receptacles 1610, 1611 is located approximately 1.2 inches from the base of the footer 1604. The center C2 of the upper kidney end 1618 is displaced approximately 0.031 inches from C1.

Referring to FIG. 16, on the right window jamb 1410, there is an insertion channel 1612 (that connects to the kidney shaped receptacle 1610. Accordingly, a connection curve 1614 is formed at the point where the kidney shaped receptacle 1610 and insertion channel 1612 meet. In a preferred embodiment, the connection curve 1614 has a radius of curvature R14 ranging in size from 0.045-0.55 inches.

The insertion channel 1612 of this alternative embodiment is similar in function to the insertion channel 214 of FIGS. 2 and 3A. It should be appreciated that there are slight differences between the insertion channel 1612 and insertion channel 214 of FIGS. 2 and 3A. For example, the displacement between C1 and C2 is 0.045, whereas the displacement between A1 and A2 of FIGS. 2 and 3A is 0.068. Additionally, there are fewer radii of curvature in the present embodiment, as compared to FIGS. 2 and 3A. Despite such differences, both embodiments fall within the scope of the present invention.

The window assembly 1400 has two stationary positions, an open-tilted and a closed position. As shown in FIGS. 16 and 17, in its closed position, the sash mating surface 1402 of the window sash 1400 is complementary to the frame mating surface 1602 of the window frame 1600. Furthermore, the pivot pins 1407 are located in the lower kidney ends 1616.

Figure 18:
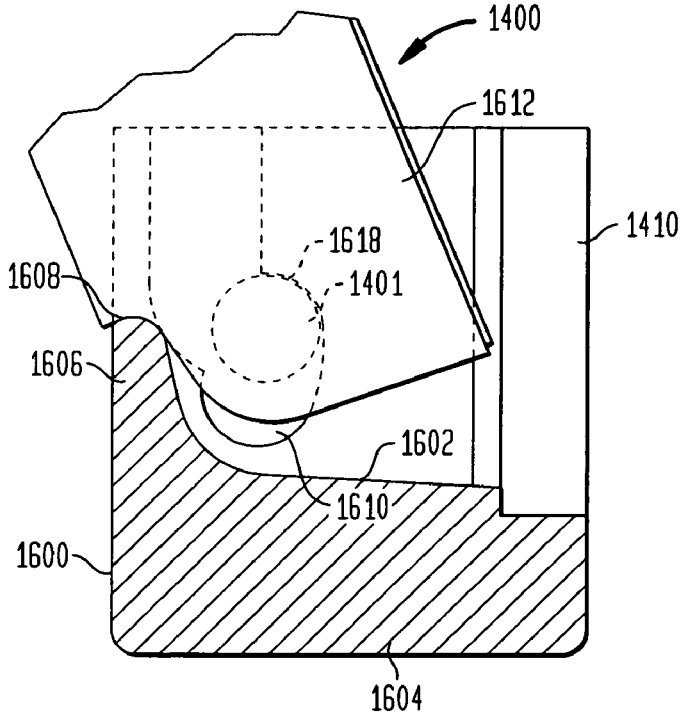
FIG. 18 is a cross-sectional cut-away view of the right window jamb of the window frame assembly shown in FIG. 16 and the window sash shown in FIG. 14 in its open-tilted position.
Figure 19:
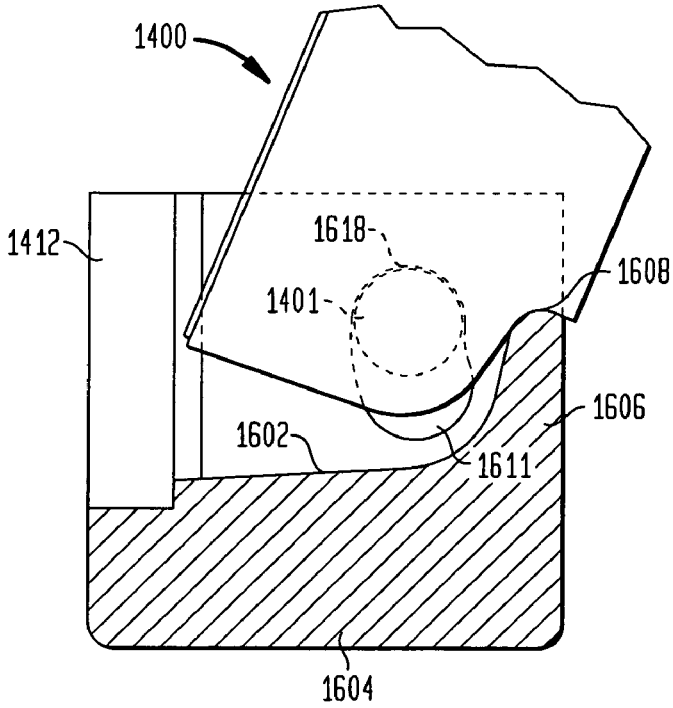
FIG. 19 is a cross-sectional cut-away view of the right window jamb of the window frame assembly shown in FIG. 16 and the sash shown in FIG. 14 in its open-tilted position.

Referring to FIGS. 18 and 19, in its open-tilted position, the pivot pins 1401 are located in the upper kidney ends 1618. The window sash is able to maintain a stable and open-tilted position when the inner edge 1404 of the window sash 1400 rests on top of or over the frame mating edge 1608 of the water dam 1606.

Although the invention herein has been described with reference to particular embodiments and preferred dimensions or ranges of measurements, it is to be understood that these embodiments are merely illustrative of the principles and applications of the present invention. Additionally, it is to be appreciated that the present invention may take on various alternative orientations. It is therefore to be understood that numerous modifications may be made to the illustrative embodiments and that other arrangements may be devised without departing from the spirit and scope of the present invention as defined by the appended claims.

The invention claimed is:

1. A window assembly comprising:

a window frame having a lower portion and a pair of opposite side portions, each of said side portions including an inner surface comprising a substantially planar surface;

a window sash constructed to be positioned within said window frame and capable of moving from a closed position to an open-tilted position and vice versa;

a pair of parallel pivot pins on said window sash, each of said pair of parallel pivot pins comprising only a single such pivot pin on each side of said window sash; and a pair of kidney shaped receptacles each including a curved upper end and a curved lower end, and comprising slots within each of said pair of opposite portions of said window frame for accepting each of said pair of parallel pivot pins to thereby accommodate movement of said window sash from said closed position to said open-tilted position and vice versa, each of said slots being formed within said window frame so as not to project beyond said substantially planar surface thereof, said curved upper and lower ends of said pair of kidney shaped receptacles defined by upper and lower radii defining the curvature of said upper and lower curved ends of said kidney shaped receptacles.

2. The window assembly of claim 1 wherein said window sash is in said open-tilted position when said window sash cooperates with said window frame so that said window sash abuts the window frame at its lower portion to limit the extent of the open-tilted position.

3. The window assembly of claim 2, wherein said lower portion of said window frame includes a water dam, and said window sash engages said water dam to define a maximum open-tilted position.

4. The window assembly of claim 3, wherein said water dam further comprises an angled portion for supporting said window sash.

5. The window assembly of claim 1, wherein at least one parallel pivot pin of said pair of parallel pivot pins is retractable.

6. The window assembly of claim 1, wherein said window frame further comprises at least one insertion channel connected to at least one kidney shaped receptacle of said of said pair of kidney shaped receptacles to permit said window sash to be inserted into said frame in a tilted position when a parallel pivot pin of said pair of parallel pivot pins engages said insertion channel and said window frame moves down into a fully inserted position.

7. The window assembly as in claim 1, wherein the only connection between said window sash and said frame is the parallel pivot pins, such that the sash can be easily removed from the frame.

8. A window assembly comprising:

a window frame comprising a pair of opposite side portions, each of said side portions including an inner surface comprising a substantially planar surface;

a window sash having a connection means to said window frame so as to allow said window sash to attain a plurality of positions within said window frame, including an open-tilted and closed position;

a supporting means for supporting said window sash in an open-tilted position;

said window frame further comprising a pair of kidney shaped channels each including a curved upper end and a curved lower end and being disposed within said pair of opposite side portions of said window frame to receive said connection means, each of said pair of kidney shaped channels being formed within said window frame so as to not project beyond said substantially planar surface thereof, said curved upper and lower ends of said pair of kidney shaped receptacles defined by upper and lower radii defining the curvature of said curved upper and lower ends of said kidney shaped receptacles.

9. The window assembly of claim 8, wherein said connection means is a pair of pivot pins.

10. The window assembly of claim 9, wherein the only connection means between said window sash and said frame is the pair of pivot pins, such that the sash can be easily removed from the frame.

11. The window assembly of claim 9, wherein said pivot pins are retractable.

12. The window assembly of claim 8, wherein said supporting means includes a water dam.

13. The window assembly of claim 8, wherein an insertion channel connects to at least one kidney shaped channel formed within said window frame.

14. A window assembly comprising:

a window frame comprising a pair of opposite side portions, each of said side portions including an inner surface comprising a substantially planar surface;

a window sash having an open-tilted position and a closed position, said window sash arranged and constructed to be positioned within said window frame so as to be capable of moving from a closed position to an open-tilted position and vice versa, said window sash further comprising a pair of pivot pins, each of said pair of parallel pivot pins comprising only a single such pivot pin on each side of said window sash;

a dual function water dam, said water dam limiting the amount of water permitted to enter a building through said window assembly, and said water dam limiting movement of and providing support to said window sash when said window sash is in said open-tilted position; and a pair of kidney shaped channels, each including a curved upper end and a curved lower end and being disposed within each of said pair of opposite side portions of said window frame that are arranged and constructed for receiving said pair of pivot pins to accommodate movement of said window sash from said closed position to said open-tilted position and vice versa, each of said pair of kidney shaped channels being formed within said window frame so as to not project beyond said substantially planar surface thereof, said curved upper and lower ends of said pair of kidney shaped receptacles defined by upper and lower radii defining the curvature of said curved upper and lower ends of said kidney shaped receptacles.

15. The window assembly of claim 14, wherein said pair of pivot pins are retractable.

16. The window assembly as in claim 15, wherein the only connection between said window sash and said frame is the parallel pivot pins, such that the sash can be easily removed from the frame.

17. The window assembly of claim 14, wherein said pair of channels are kidney shaped channels.

18. The window assembly of claim 17, wherein said window frame further comprises an insertion channel, said insertion channel connecting to at least one kidney shaped channel of said pair of kidney shaped channels.

19. The window assembly as in claim 14, wherein the only connection between said window sash and said frame is the parallel pivot pins, such that the sash can be easily removed from the frame.

20. A window assembly comprising:

a window frame having a first horizontal arm, a second horizontal arm, a first vertical arm, and a second vertical arm, each of said first and second vertical arms including an inner surface comprising a substantially planar surface;

an opening in said window frame;

a window sash comprising a first horizontal sash rail, a second horizontal sash rail, a first vertical sash rail, and a second vertical sash rail, said window sash arranged and constructed for insertion into said opening of said window frame; said window sash having a plurality of angular positions within said window frame, including an open-tilted position and a closed position;

a connecting means for connecting said window sash and said fixed window frame;

a first channel within said first vertical arm, and a second channel within said second vertical arm, said first and second channels being in the shape of a kidney including a curved upper end and a curved lower end and capable of receiving said connection means each of said first and second channels being formed within said first and second vertical arms so as to not project beyond said substantially planar surfaces thereof, said curved upper end and lower end of said first and second channel defined by upper and lower radii defining the curvature of said curved upper and lower ends of said first and second channels; and a support means for supporting the window sash in said open position.

21. The window assembly of claim 20, wherein said support means is a water dam.

22. The window assembly of claim 20, wherein an insertion channel connects to either or both said first and said second channel.

23. The window assembly of claim 20, wherein said connection means for connecting said window sash and said fixed window frame is a single pair of pivot pins.

24. The window assembly of claim 23, wherein at least a pivot pin of said single pair of pivot pins is retractable.

25. The window assembly of claim 23, wherein the only connection means between said window sash and said frame is the single pair of pivot pins, such that the sash can be easily removed from the frame.

26. A window assembly comprising:

a window frame having a first and second horizontal arm, and a first and second vertical arm, each of said first and second vertical arms including an inner surface comprising a substantially planar surface;

a kidney shaped channel having a curved upper end and a curved lower end and being disposed within at least one of said first and said vertical arms of said fixed window frame, said kidney shaped channel being formed within said first or second vertical arms so as not to project beyond said substantially planar surfaces thereof, said curved upper and lower ends of said kidney shaped channels defined by upper and lower radii defining the curvature of said curved upper and lower ends of said kidney shaped channel;

a window sash having a first and second horizontal sash rail, and a first and a second vertical sash rail, said window sash arranged and constructed so as to be inserted into said window frame, said window sash having an open position and a closed position, said window sash further having only a single pivot pin located in a vertical sash rail so as to be received by said kidney shaped channel; and a support means for supporting said window sash when said window sash is in an open position.

27. The window assembly of claim 26, wherein said support means includes a water dam.

28. The window assembly of claim 26, wherein an insertion channel connects to said kidney shaped channel.

29. The window assembly of claim 26, wherein said pin is retractable.

30. The window assembly of claim 26, wherein the only connection between said window sash and said frame is the pivot pin such that the sash can be easily removed.

31. A window assembly comprising:

a window frame having a water dam and including a pair of opposite side portions, each of said pair of opposite side portions including an inner surface comprising a substantially planar surface;

a window sash constructed to be positioned within said window frame and capable of moving from a closed position to an open-tilted position and vice versa;

a pair of parallel pivot pins on said window sash, each of said pair of parallel pivot pins comprising only a single such pivot pin on each side of said window sash; and a pair of kidney shaped receptacles each including a curved upper end and a curved lower end and being disposed within each of said pair of opposite side portions of said window frame which accommodate movement of said window sash from said closed position to said open-tilted position and vice versa, each of said pair of kidney shaped receptacles being formed within said pair of opposite side portions so as to not project beyond said substantially planar surfaces thereof, said curved upper and lower ends of said pair of kidney shaped receptacles defined by upper and lower radii defining the curvature of said curved upper and lower ends of said kidney shaped receptacles, wherein said water dam of said window frame limits movement of and supports said window sash when said window sash is in said open-tilted position.

* * * * *

UNITED STATES PATENT AND TRADEMARK OFFICE

CERTIFICATE OF CORRECTION

PATENT NO. : 7,481,026 B2
APPLICATION NO. : 10/672331
DATED : January 27, 2009
INVENTOR(S) : Arthur Silverman It is certified that error appears in the above-identified patent and that said Letters Patent is hereby corrected as shown below:

On the Title Page, Item (54) delete "TILT WINDOW ASSEMBLY" and insert therefor --MOLDED BASEMENT HOPPER WINDOW--.

Column 1, line 1, delete "TILT WINDOW ASSEMBLY" and insert therefor --MOLDED BASEMENT HOPPER WINDOW--.

Signed and Sealed this

Ninth Day of March, 2010

David J. Kappos

David J. Kappos
*Director of the United States Patent and Trademark Office*